US005941035A

United States Patent [19]

Purse

[11] Patent Number: 5,941,035

[45] Date of Patent: Aug. 24, 1999

[54] STEEL JOIST AND CONCRETE FLOOR SYSTEM

[75] Inventor: John A. C. Purse, Surrey, Canada

[73] Assignee: Mega Building System Ltd., Canada

[21] Appl. No.: 08/923,381

[22] Filed: Sep. 3, 1997

[51] Int. Cl.[6] ..... E04B 5/40

[52] U.S. Cl. ..... 52/263; 52/326; 52/333; 52/336; 52/338; 52/450; 52/252; 52/334

[58] Field of Search ..... 52/319, 326, 333, 52/334, 336, 338, 339, 261, 263, 690, 692, 693, 694, 450, 250, 252

[56] References Cited

U.S. PATENT DOCUMENTS

| | | | |
|---|---|---|---|
| 1,435,337 | 11/1922 | Sands . | |
| 1,507,046 | 9/1924 | Cockerell et al. . | |
| 1,576,846 | 3/1926 | Pomfret . | |
| 1,980,372 | 11/1934 | Blair et al. . | |
| 3,735,953 | 5/1973 | Dashew et al. . | |
| 3,979,868 | 9/1976 | Butts et al. . | |
| 4,186,535 | 2/1980 | Morton | 52/250 |
| 4,432,178 | 2/1984 | Taft . | |
| 4,454,695 | 6/1984 | Person . | |
| 4,566,240 | 1/1986 | Schilger . | |
| 4,592,184 | 6/1986 | Person et al. . | |
| 4,628,654 | 12/1986 | Boswel . | |
| 4,653,237 | 3/1987 | Taft . | |
| 4,685,264 | 8/1987 | Landis . | |
| 4,700,519 | 10/1987 | Person et al. . | |
| 4,726,159 | 2/1988 | Stohs . | |
| 4,837,994 | 6/1989 | Stohs . | |
| 4,845,908 | 7/1989 | Stohs . | |
| 5,050,358 | 9/1991 | Vladislavic . | |
| 5,220,761 | 6/1993 | Selby . | |
| 5,337,532 | 8/1994 | Reid . | |
| 5,544,464 | 8/1996 | Dutil . | |

OTHER PUBLICATIONS

Canadian Steel Manufacturing Division of British Steel Canada Inc., Comfloor 210 Practical Design Details, Apr. 1995.

Canadian Steel Manufacturing Division of British Steel Canada Inc., The Comflor Composite Floor System Brochure, 2 pages.

canam hambro A division of The Canam Manac Group Inc., hambro Composite Floor Systems pp. 1–4.

Vulcraft A Division of Nucor Corporation, Vulcraft Steel Roof and Floor Deck manual, 1996, cover page, pp. 18, 19, 41 and back page.

Vulcraft A Division of Nucor Corporation, Vulcraft Floor Systems Design Manual, 1995 pp. 45–54, and back page.

Vulcraft A Division of Nucor Corporation, Vulcraft Steel Joists and Joist Girders, 1995 cover page, pp. 30, 32, 33, 41, 65 and the back page.

*Primary Examiner*—Carl D. Friedman
*Assistant Examiner*—Yvonne Horton-Richardson
*Attorney, Agent, or Firm*—Chernoff, Vilhauer, McClung & Stenzel, LLP

[57] ABSTRACT

A concrete floor system includes the use of sheet metal pan or decking and sheet metal z-shaped closures sitting upon low profile open web steel joist providing a non-structural or structural concrete brake above the walls forming vibration damping and sound & fire barriers. The z-shaped closures have apertures formed through them which correspond to the end profiles of the joist shoes of the joists, and are fitted onto the joists before or after the joists are in place. The need for sound and vibration damping rock wool, foams and other similar material below the floor and between walls is eliminated.

17 Claims, 9 Drawing Sheets

STEEL JOIST AND CONCRETE FLOOR SYSTEM

TECHNICAL FIELD

This invention relates to concrete floor systems and to methods for constructing concrete floors. More particularly, the invention relates to concrete floor systems incorporating low profile open web steel joists.

BACKGROUND

Larger scale multi-story buildings are typically constructed primarily of steel and concrete. Floors in such buildings are typically constructed by spanning steel joists between structural walls and laying a metal pan or decking across the tops of such joists. The decking forms a flat surface onto which concrete is poured. Generally, the bottoms of the joists form the framework from which ceilings are hung.

Although such flooring systems are common, there are a number of difficulties associated with them. First, such systems generally allow only for floors of a uniform thickness. This in and of itself is a problem, especially when dealing with adjacent suites having different ceiling heights. Furthermore, a great deal of time, effort and money must be expended to obtain the required sound and fire protection between adjacent suites in such buildings, and between adjacent floors or stories of the building.

In such conventional systems, large gaps or airspaces are formed between the tops of the walls on which the joists sit and the underside of the metal decking which sits on top of the "joist shoes" of the joists. These joist shoes are formed by the ends of the top chords of such joists, and angle irons welded to the undersides of this portion of the top chord. One such gap is formed between each pair of adjacent joists. Depending on the size of the joist shoes, these gaps are typically between 2 and 12 inches high, and extend along the length of the support wall. Such gaps are customarily filled with rock-wool, foaming products, fire-tape and/or double layers of gypsum board. The filling of these gaps is typically done manually from underneath the poured floor, and is accordingly labour intensive and costly. Often, this job is done poorly, leading to failed fire code inspections necessitating costly repairs. Even when done correctly, this time consuming filling of such gaps does not leave a particularly sound and fire-resistant floor and wall between suites.

There have been a number of composite concrete and steel floor systems suggested which ameliorate this gap problem somewhat. For example, in U.S. Pat. No. 4,454,695, which issued in 1984, Person discloses a composite floor system including a plurality of joists which have a top chord which allows metal decking to be placed not atop the joists, but between them. Poured concrete embeds the top chords of the joists. Similar systems are disclosed in U.S. Pat. Nos. 4,700,519 and 5,544,464.

With these systems, the gaps between the tops of the supporting walls on which the joists rest and the underside of the metal decking are reduced, although not eliminated. However, such systems have associated with them other difficulties which render them inadequate for use in some situations. For example, because the metal pans used in such systems do not rest on top of the joists themselves, but rather between the joists on angle irons which form the top chords of the joists, sections of metal pan must be carefully cut to identical lengths in installing such systems. This is time consuming. Furthermore, it is often necessary to move one or more joists by a few inches to accommodate between-floor services such as plumbing. When one joist is moved, two metal pans of different lengths must be custom-cut. This leads to wastage of material.

These prior art composite floors have one first her significant disadvantage in that they transmit vibrations exceedingly well. The steel joists, being embedded within concrete along their entire lengths, form part of the floor itself. Thus, a vibration caused by, for example, a washing machine operating in one suite can be transmitted throughout the entire floor of the building.

To overcome this vibration problem, composite floor systems often employ more concrete than would otherwise be necessary to dampen vibration. This of course increases the weight of such floors, which may require shoring while concrete is curing. Shoring adds to the floor cost and to construction time. Excess concrete may also require that the building be built on stronger foundations. In some areas, ground or soil conditions may militate against such heavier buildings. Also, higher profile joists are required to support the heavier floors. Accordingly, fewer floors can be built in a building of a given height.

Additionally, when concrete floor slabs are kept relatively thin, the placement of plumbing and other between-floor services is less time consuming and problematic. Conventionally, in a thicker floor, hollow pipes or "cans" must be put into place when the floor is being poured to provide apertures for between-floor services such as plumbing. The placement of these cans is critical and such cans are commonly placed in the wrong location, necessitating costly and time consuming movement of between-floor services to match the incorrect placement of the cans. It is also labour intensive and costly to finish the concrete floor surface around these cans. This may results in a poor quality floor surface. Apertures may be made in a thinner floor by drilling or "coring" after the concrete is poured.

There is accordingly a need for a floor system which overcomes the problems of gaps or airspaces between adjacent suites, and which does not have the disadvantages of composite floors in which joists are embedded entirely in the concrete which forms the floor.

SUMMARY OF INVENTION

The concrete floor system disclosed herein comprises a first generally vertical load-bearing wall; a plurality of steel joists extending from the top of the wall to a second load bearing wall, each of the joists having a top chord, a bottom chord, webbing between the top and bottom chords, and joist shoes having a generally I-shaped profile formed on each end of the joists, the joist shoes resting on the wall; metal decking supported on and attached to the top of the joists; means for enclosing the volume formed between the top of the wall, the underside of the metal decking, and the joists, and a concrete slab poured onto the metal decking and into the enclosed volume. A force-distributing plate may cap the top of the wall.

The volume enclosing means may comprise a generally z-shaped closure fitted onto each of the joist shoes, each of the closures having a vertical face, an I-shaped void formed in the face intermediate the ends of the closure, the void corresponding to the profile of the joist shoes, a lower flange extending from the bottom of the closure face toward the centre of the wall, the lower flange resting on top of the distribution plate when the closure is fitted onto the joist shoe, and an upper flange extending from the top of the closure face which rests on top of the joist shoe, the closure when fitted onto the joist shoe forming a vertical wall between the distribution plate and the top of the joist shoe and between adjacent joists, thereby forming a concrete-accepting trough when fitted onto joists extending in opposite directions away from the wall.

In a preferred embodiment, the metal decking overlaps the top flanges of the closures, and the poured concrete embeds at least a portion of the joists. Adjacent of the closures may overlap longitudinally when fitted onto adjacent joists.

The faces of the closures may occupy generally the same vertical plane as one of the faces of the wall, or may occupy a vertical plane farther from the centre of the wall than the wall face. Wire mesh and reinforcing rods may be embedded into the concrete to add strength.

A method for constructing a concrete floor is also disclosed, the method comprising the steps of providing at least one load bearing wall capped with a force-distributing plate; inserting joist shoes of open web steel joists through an I-shaped void in a z-shaped closure having a face, and oppositely extending upper and lower flanges; placing plurality of the joists onto the force-distributing plate, the fitted closures thereby forming a concrete-accepting trough; applying metal decking to the tops of the joists, overlapping the upper flanges of the closures; and pouring the concrete onto the decking and into the trough. The method may further comprise the steps of allowing the concrete to cure, forming a concrete slab floor; and drilling holes in the slab floor to accommodate plumbing and electrical services.

Alternatively, the method for constructing a concrete floor may comprise the steps of providing at least one load bearing wall capped with a force distributing plate; placing plurality of open web steel joists having joist shoes onto the force-distributing plate; fitting z-shaped closures having a face, and oppositely extending upper and lower flanges onto joist shoes of the joists, thereby forming a concrete-accepting trough; applying metal decking to the tops of the joists, overlapping the upper flanges of the closures; and pouring the concrete onto the decking and into the trough.

BRIEF DESCRIPTION OF DRAWINGS

In drawings which illustrate specific embodiments of the invention, but which should not be construed as restricting the spirit or scope of the invention in any way.

DESCRIPTION

Figure 1:
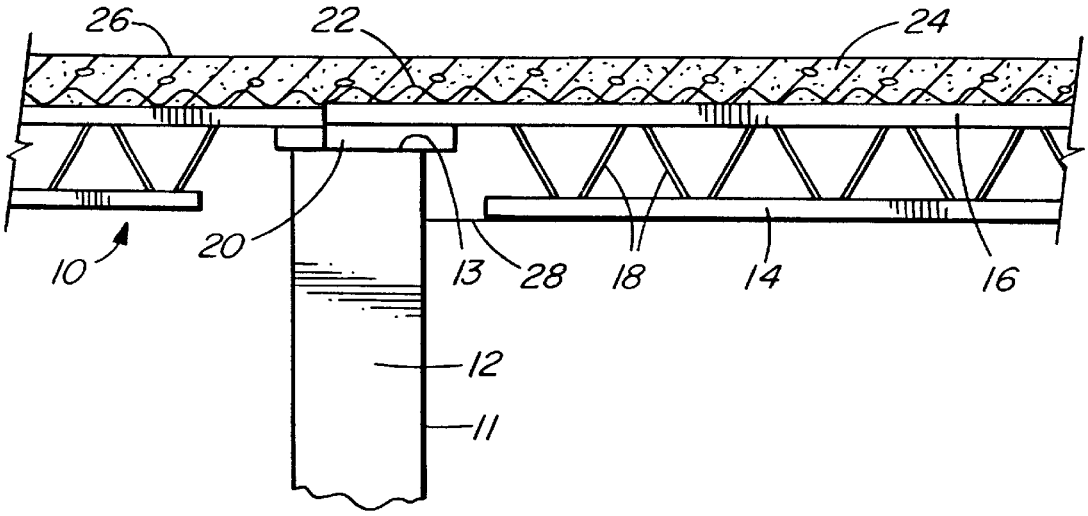
FIG. 1 (PRIOR ART)
FIG. 1 is a side view in cross-section of a typical prior art concrete and steel joist floor system.
Figure 2:
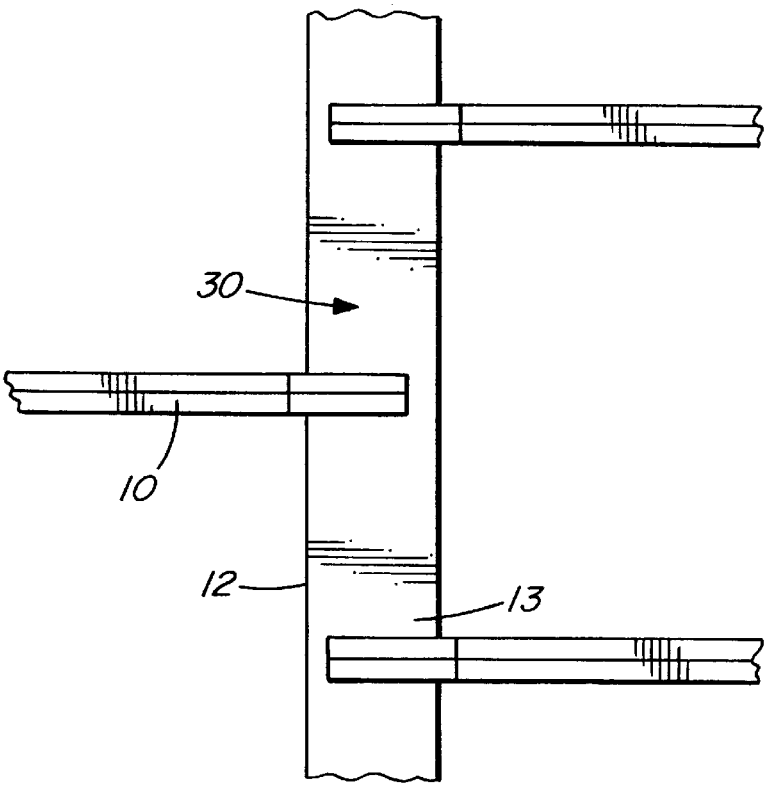
FIG. 2 (PRIOR ART)
FIG. 2 is a top view of the prior art floor system shown in FIG. 1, showing a load bearing wall and joists, not showing metal decking.

In a conventional steel joist and concrete floor systems used in a large-scale building, illustrated in schematic form in FIGS. 1 and 2, open web steel joists 10 rest on structural supports such as beams or a load-bearing wall 12. Wall 12 may be constructed of steel studs, red-iron, brick, block, poured concrete or other such material.

Joists 10 have a bottom chord 14 and a top chord 16, connected by a plurality of web members 18. Top and bottom chords 16, 14 generally comprise angle irons welded to web members 18. Top chord 16 typically has a further pair of angle irons welded to its underside at both ends, together forming joist shoes 20 which rest upon top surface 13 of wall 12. When in place on wall 12, joists 10 are generally parallel. Although joists 10 extending in opposite directions from wall 12 may be longitudinally aligned, they are preferably staggered, as shown in FIG. 2. Typically, adjacent joists are spaced apart by 120 cm centre to centre. Joist shoes 20 space top chords 16 above top surface 13 of wall 12.

Typically, a corrugated metal pan or decking 22 (shown in FIG. 1) rests on top of top chords 16 of joists 10, and may be secured thereto by any suitable means such as welds or screws. Concrete 24 is then poured over top of decking 22 and, when cured, forms concrete floor 26. Reinforcing material may be placed on decking 22 before concrete 24 is poured to reinforce floor 26. Ceilings 28 are typically attached to the underside of bottom chord 14 of joists 10. Plumbing, electrical wiring and the like is usually contained within the space between bottom chord 14 and top chord 16.

As is readily apparent, gaps or airspaces 30 (FIG. 2) are formed in such floor systems between the top surface 13 of wall 12 and the underside of metal decking 22, between adjacent sets of joist shoes 20. These gaps are undesirable.

Figure 3:
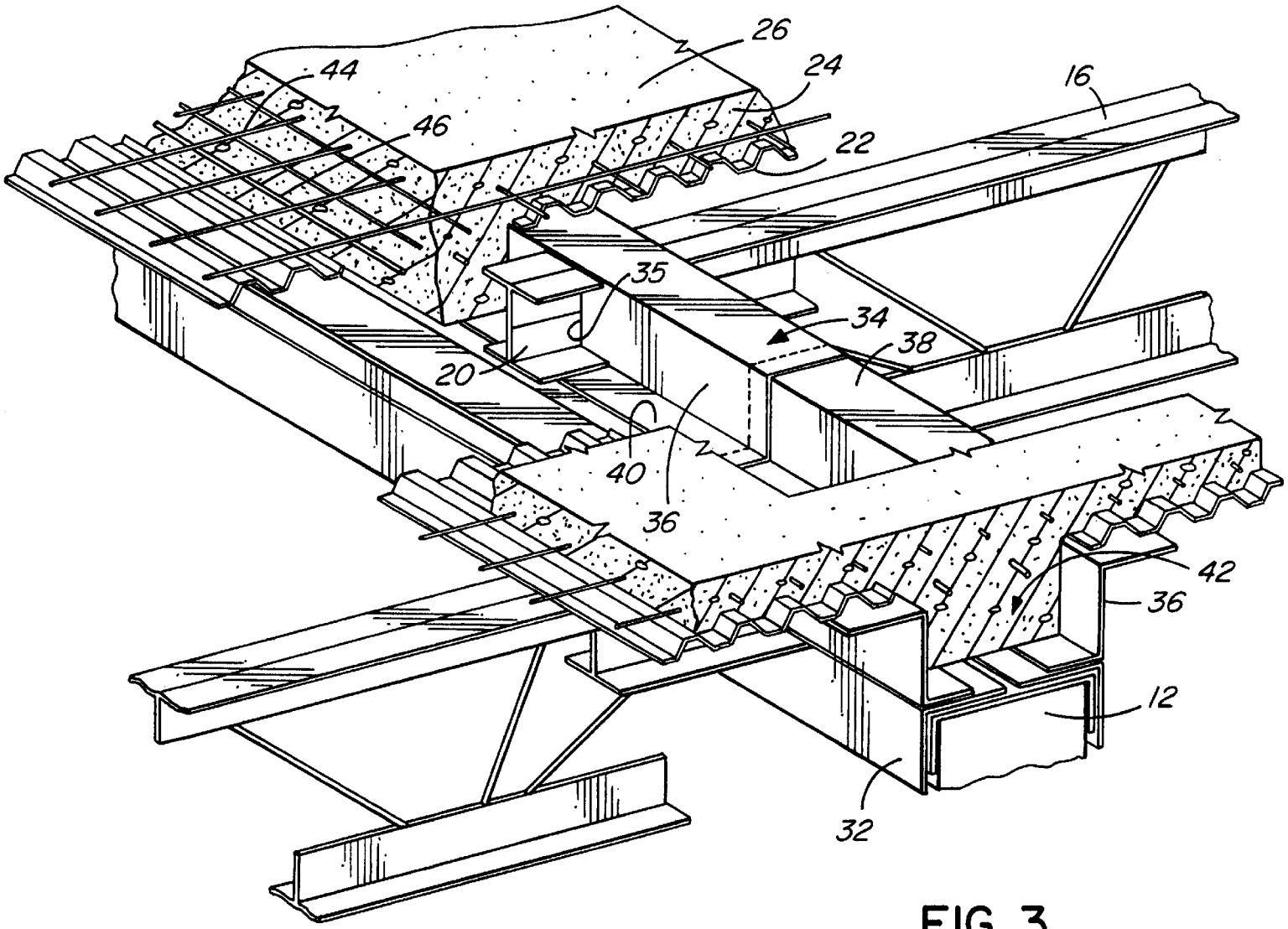
FIG. 3 is a perspective view of a steel joist and concrete floor system made in accordance with one embodiment of the invention, with concrete cut away, viewed from overhead.
Figure 4:
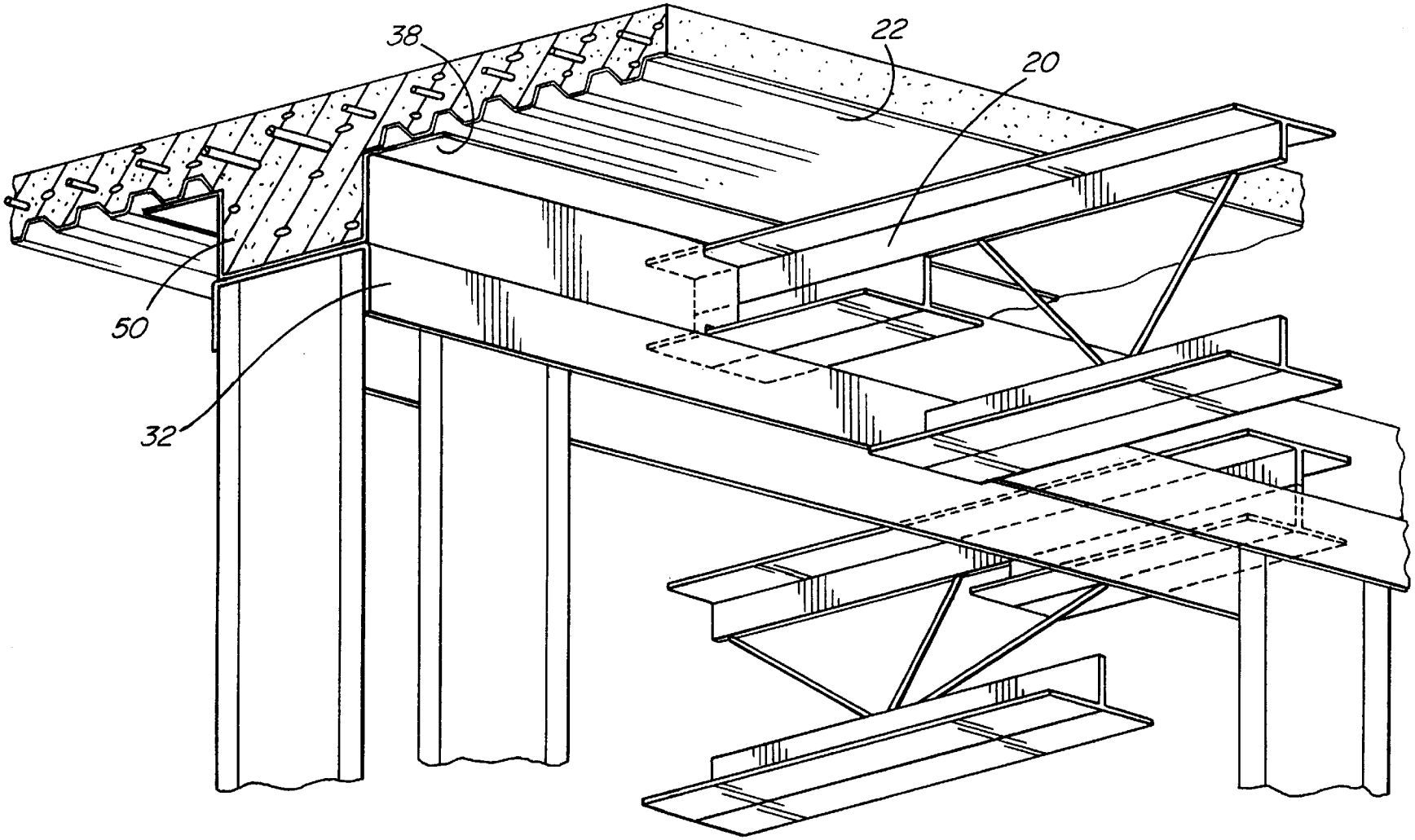
FIG. 4 is a perspective view of the floor system of FIG. 3, viewed from underneath the floor.

In a floor system made in accordance with one embodiment of the present invention, shown in FIGS. 3 and 4, load bearing wall 12 is capped by distribution plate 32 for distributing force along the length of wall 12. Distribution plate 32 allows joists 10 to be staggered thus reducing sound and vibration conducted from one side of wall 12 to the other. Z-shaped closures 34 are placed atop of distribution plate 32. Closures 34 have a generally vertical face 36, an upper generally horizontal flange 38 extending away from wall 12, and a lower generally horizontal flange 40 extending in the opposite direction. Closures 34 may conveniently be formed from sheet metal.

Figure 5:
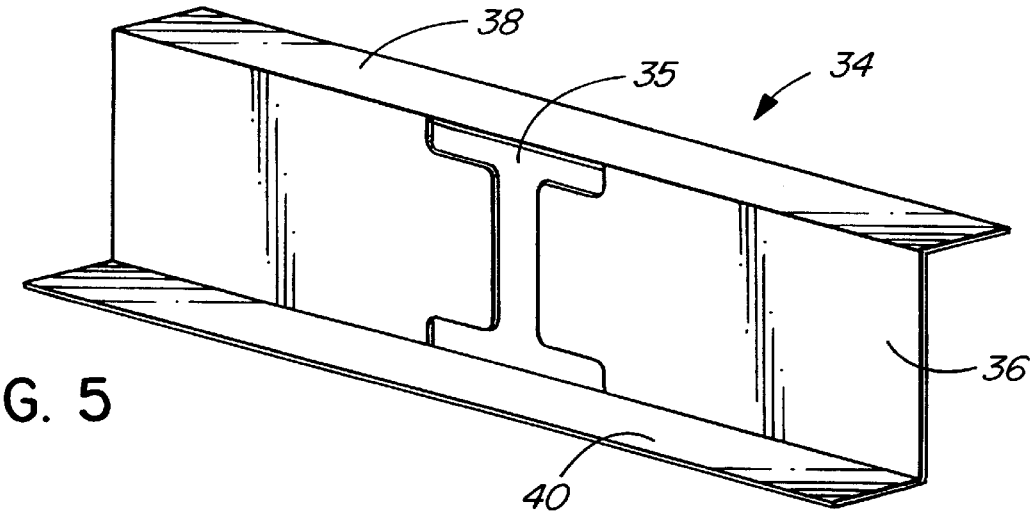
FIG. 5 is a perspective view of the concrete closure of one embodiment of the invention.
Figure 8:
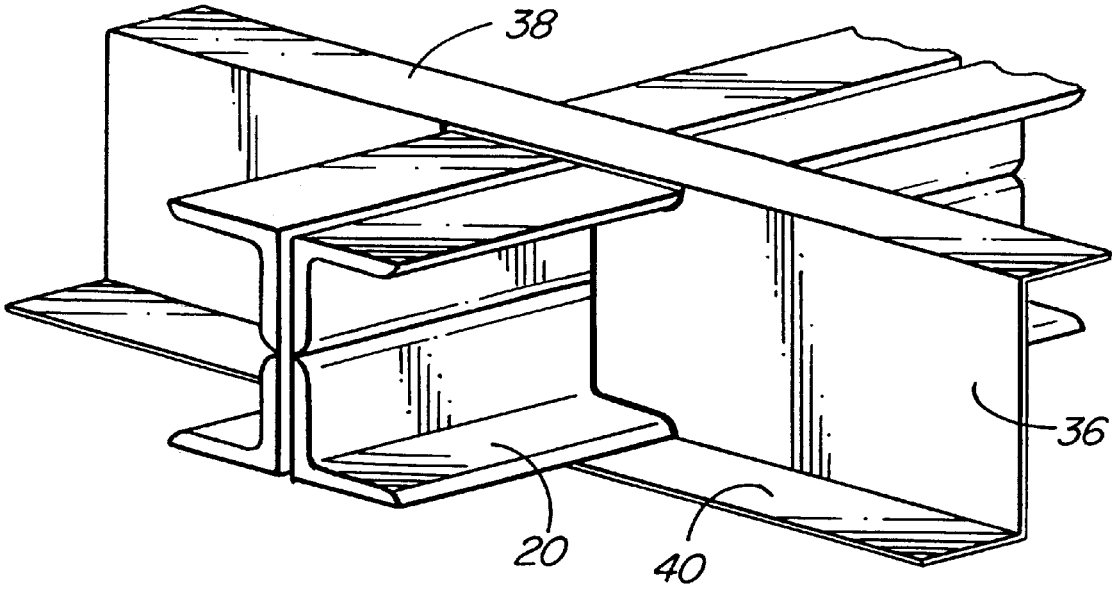
FIG. 8 is a top perspective view of the closure shown in FIG. 5 fitted onto the joist shoe of a joist.

As shown in FIG. 5, each closure 34 has a generally "I"-shaped aperture 35 corresponding to the end profile of joist shoe 20. Closure 34 is fitted onto joist 10 and joist shoe 20 protrudes through closure 34 when resting on wall 12, as shown best in FIG. 8. Closures 34 are preferably long enough to overlap longitudinally when fitted onto adjacent joists 10, as shown in FIG. 3. Although closures 34 will generally be of equal length, they are not required to be. Where the distance between adjacent joists is longer or shorter than the usual distance (for example, when one joist has to be moved to accommodate plumbing), the length of closures 34 may be varied accordingly to ensure overlap.

A trough 42 is formed atop wall 12 when closures 34 are fitted onto joists extending in opposite directions from wall 12.

Corrugated metal decking 22, with corrugations preferably running perpendicularly to joists 10, is placed atop top chords 16 of joists 10. Metal decking 22 extends along the length of joists 10 from upper flange 38 of a closure 34 fitted to one end of joist 10, to upper flange 38 of another closure 34 fitted to the opposite end of joist 10. Decking 22 may be attached to upper flanges 38 of closures 34 by screws or by any other suitable means.

Concrete 24 is poured onto metal decking 22 and is allowed to fill trough 42. Concrete 24 may be reinforced with wire mesh or reinforcing bars 46. Those portions of joist shoes 20 which protrude into trough 42 become embedded in concrete 24. When cured, concrete floor 26 and a beam portion 50 in trough 42 are formed. The filling of the spaces above wall 12 and below metal decking 22 with concrete obviates the need to install sound and fire proofing from below. The system does not require shoring and thus allows greater access for workmen to commence work directly after the floor has cured decreasing the time span of the construction phase. It will also be appreciated that the system can be designed to accommodate load bearing walls of virtually any practical width.

Figure 6:
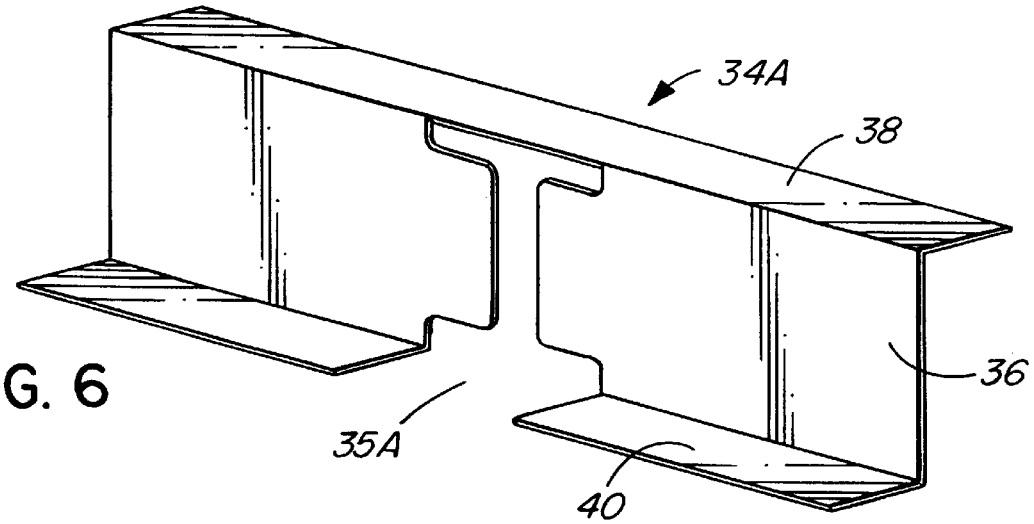
FIG. 6 is a perspective view of a concrete closure of a further embodiment of the invention.
Figure 9:
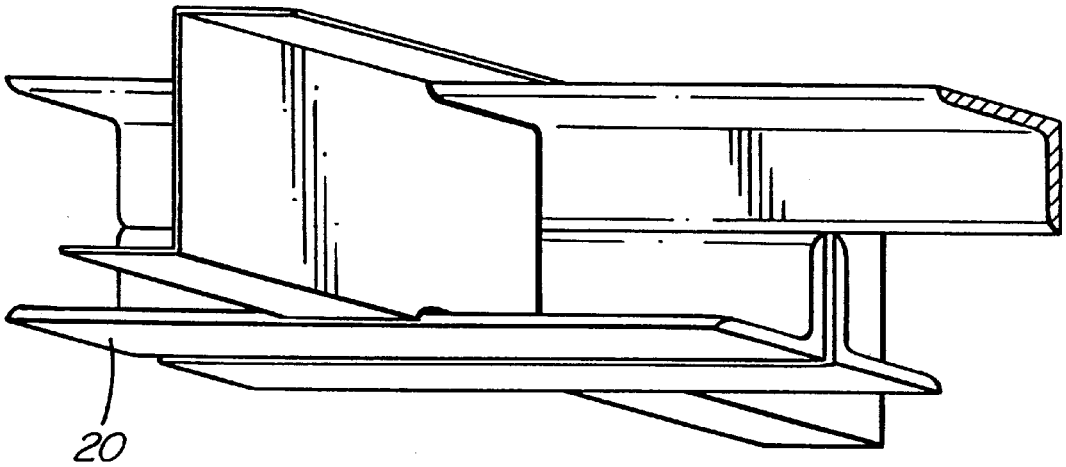
FIG. 9 is a bottom perspective view of the closure shown in FIG. 6 fitted onto the joist shoe of a joist.

In the embodiment of the invention discussed above, closures 34 must be fitted onto joist shoes 20 before shoes 20 are placed onto top surface 13 of wall 12. Alternatively, as shown in FIG. 6, closures 34A may have a fiber cut out section 35A, which extends through lower flange 40 so that closure 34A can be fitted onto joist shoes 20 without the need for joist shoes 20 to be lifted up from top surface 13 of wall 12. FIG. 9 shows a closure 34A fitted onto a joist shoe 20.

Figure 7:
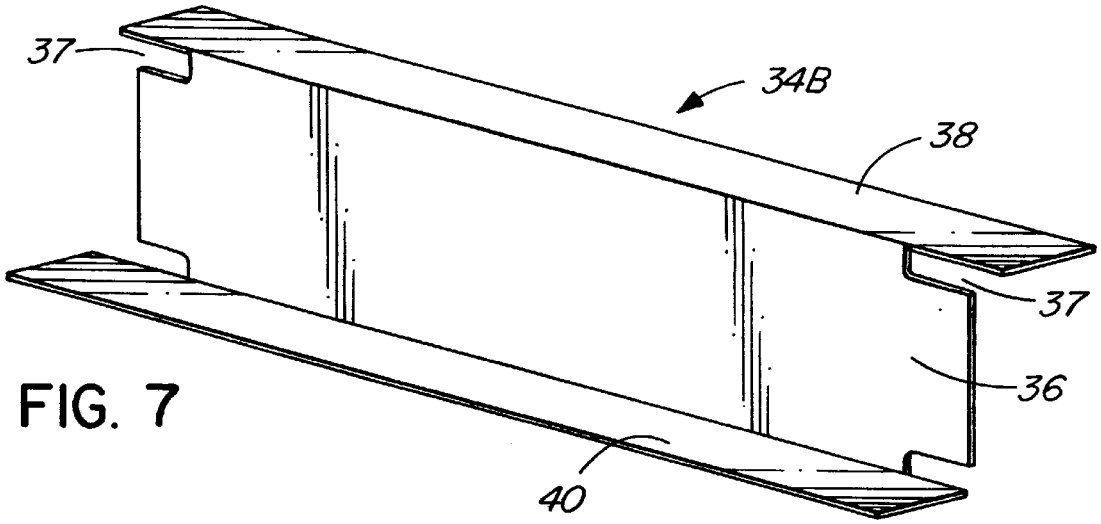
FIG. 7 is a perspective view of a concrete closure of a further embodiment of the invention.

It will be appreciated that although the above-discussed closures are preferred, other shapes of closures would also be suitable for use. For example, in a further embodiment (shown in FIG. 7) closures 34B do not have joist shoe engaging cutouts intermediate their ends, but rather, have half-I-shaped cutouts 37 at each end. Closures 34B may be fitted between adjacent joists. Cutouts 37 conform closely to joists 10 at each end to form a trough capable of holding concrete.

Figure 10:
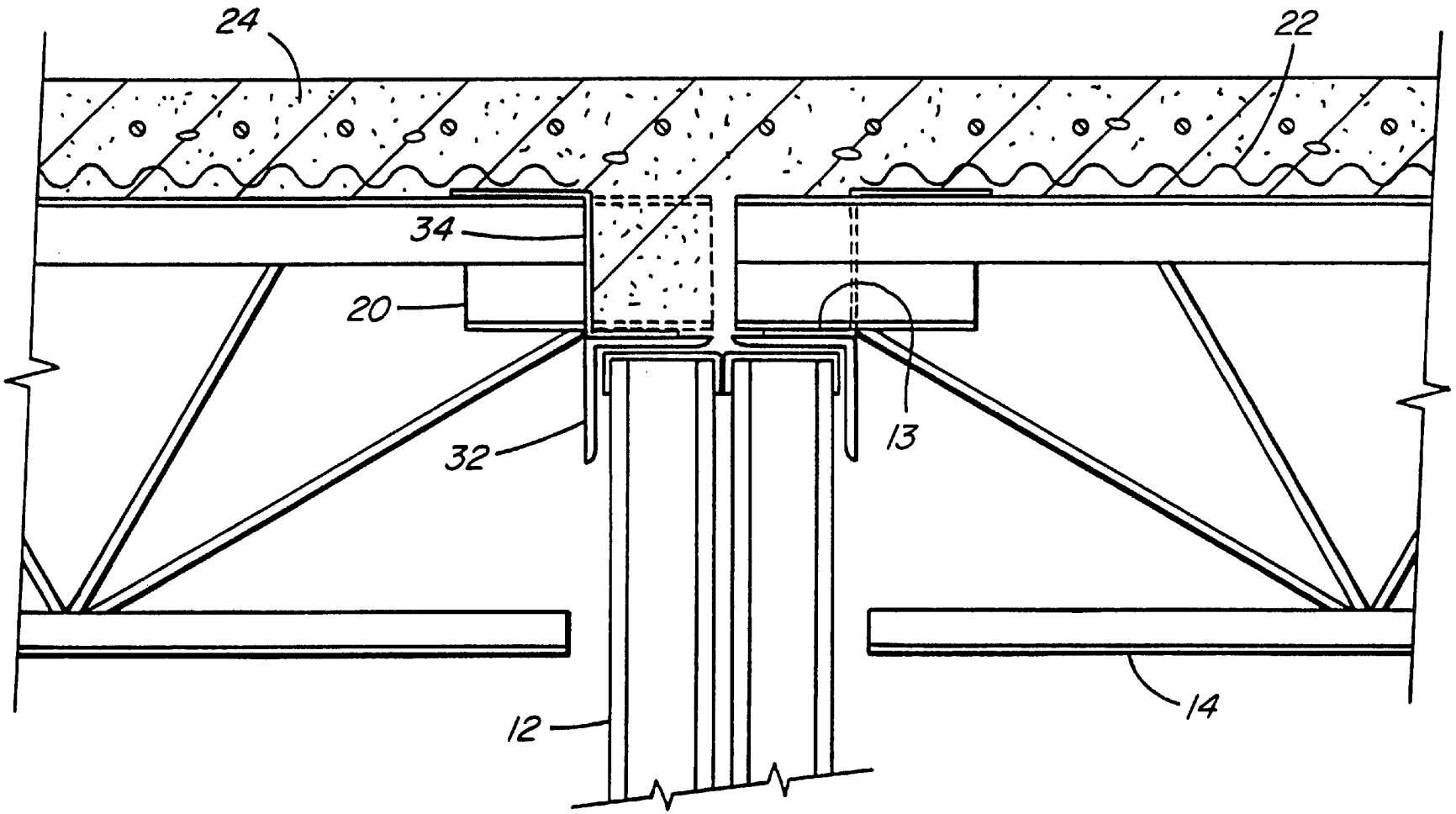
FIG. 10 is a schematic side elevational view in cross-section of a floor constructed in accordance with one embodiment of the invention.

FIG. 10 shows one embodiment of the invention schematically. As shown, there may be a plurality of distribution plates 32 extending along the top surface of wall 12. Joist shoes 20 do not necessarily have to extend across the entire top surface 13 of wall 12.

Figure 11:
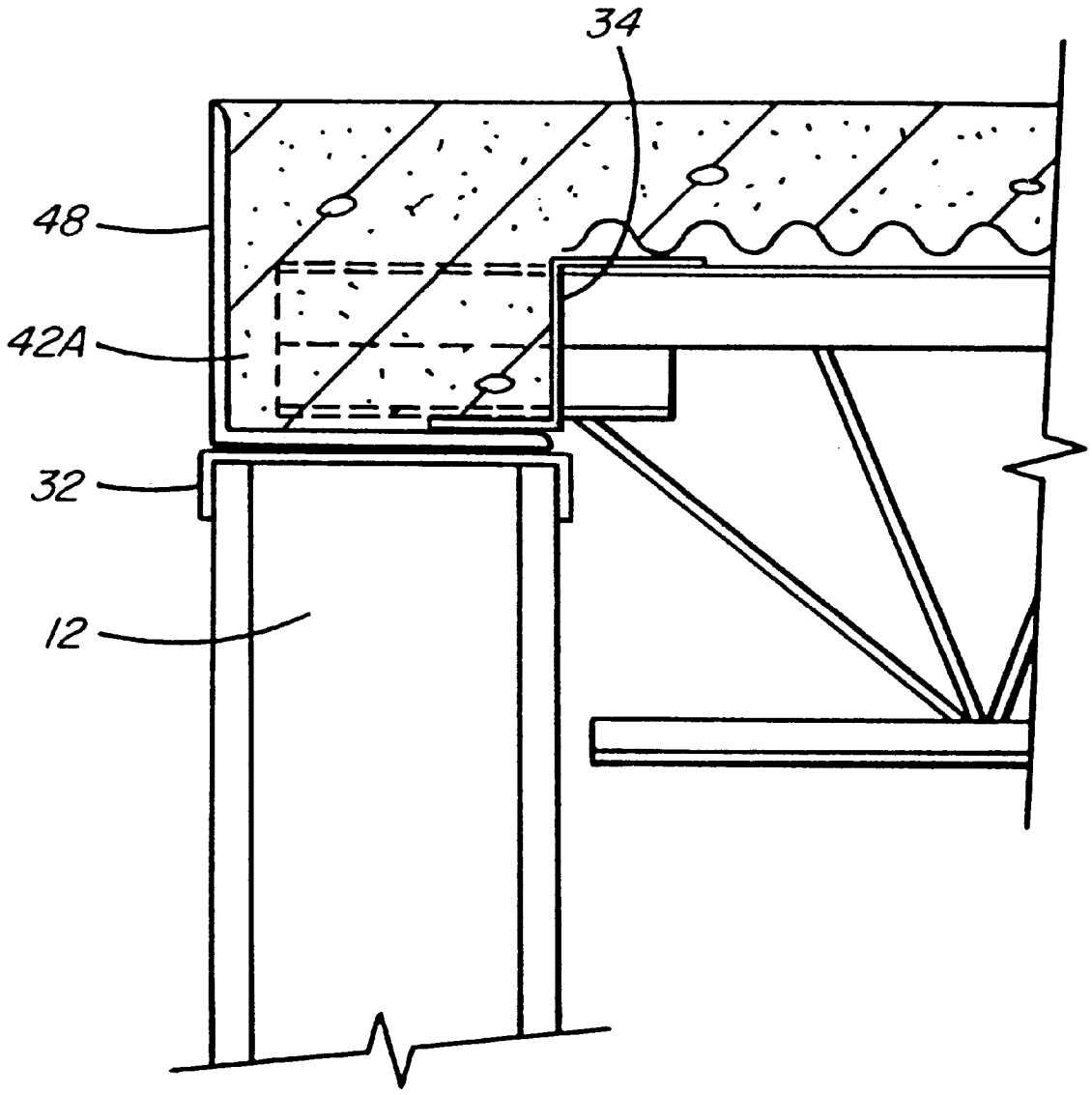
FIG. 11 is a schematic side elevational view in cross-section of a floor constructed in accordance with a further embodiment of the invention.

As shown in FIG. 11, the present invention operates in substantially the same manner when dealing with an end wall 12 as it does when wall 12 is in the middle of a building. Here, end-wall angle iron 48 is fixed atop of distribution plate 32 on wall 12. Angle iron 48 has a horizontal surface and a vertical surface which together with closure 34 form a trough 42A for accepting concrete 24.

Figure 12:
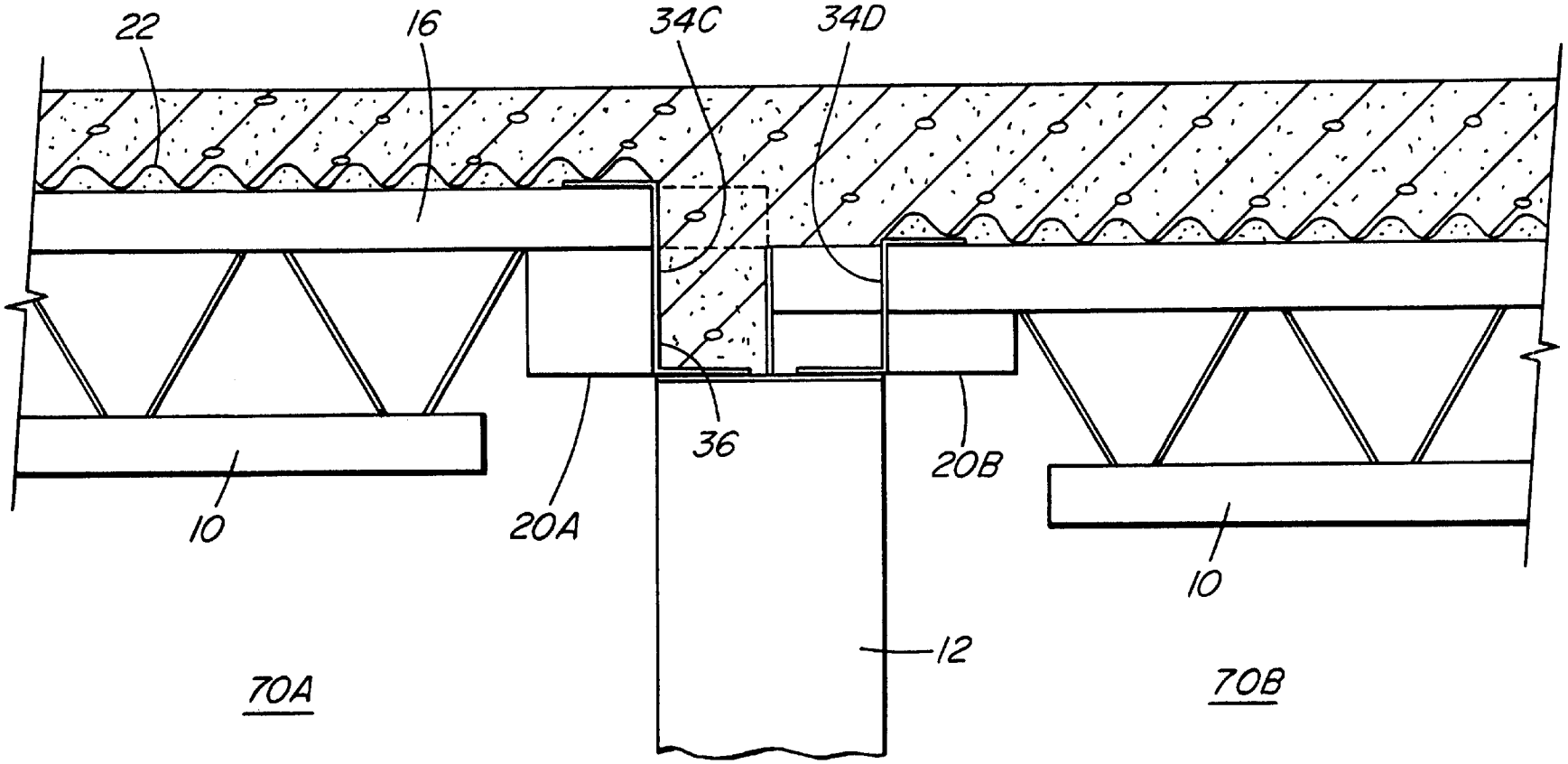
FIG. 12 is a schematic side elevational view in cross-section of a floor constructed in accordance with a further embodiment of the invention.

As shown in FIG. 12, the system of the present invention is particularly suited for situations wherein rooms, which may be, for example, living suites, on opposite sides of a structural wall 12 have different ceiling heights. In this situation, joists 10 extending from wall 12 towards the suite 70A with higher ceilings have a deeper joist shoe 20A and joists extending from wall 12 the opposite way into suite 70B which has lower ceilings due to shallower joist shoes 20B. Closure 34C associated with the deeper joist shoe 20 has a correspondingly higher face 36 than closure 34D associated with shallower joist shoe 20, and a larger I-shaped cut out dimensioned to fit around joist shoe 20A.

Figure 13:
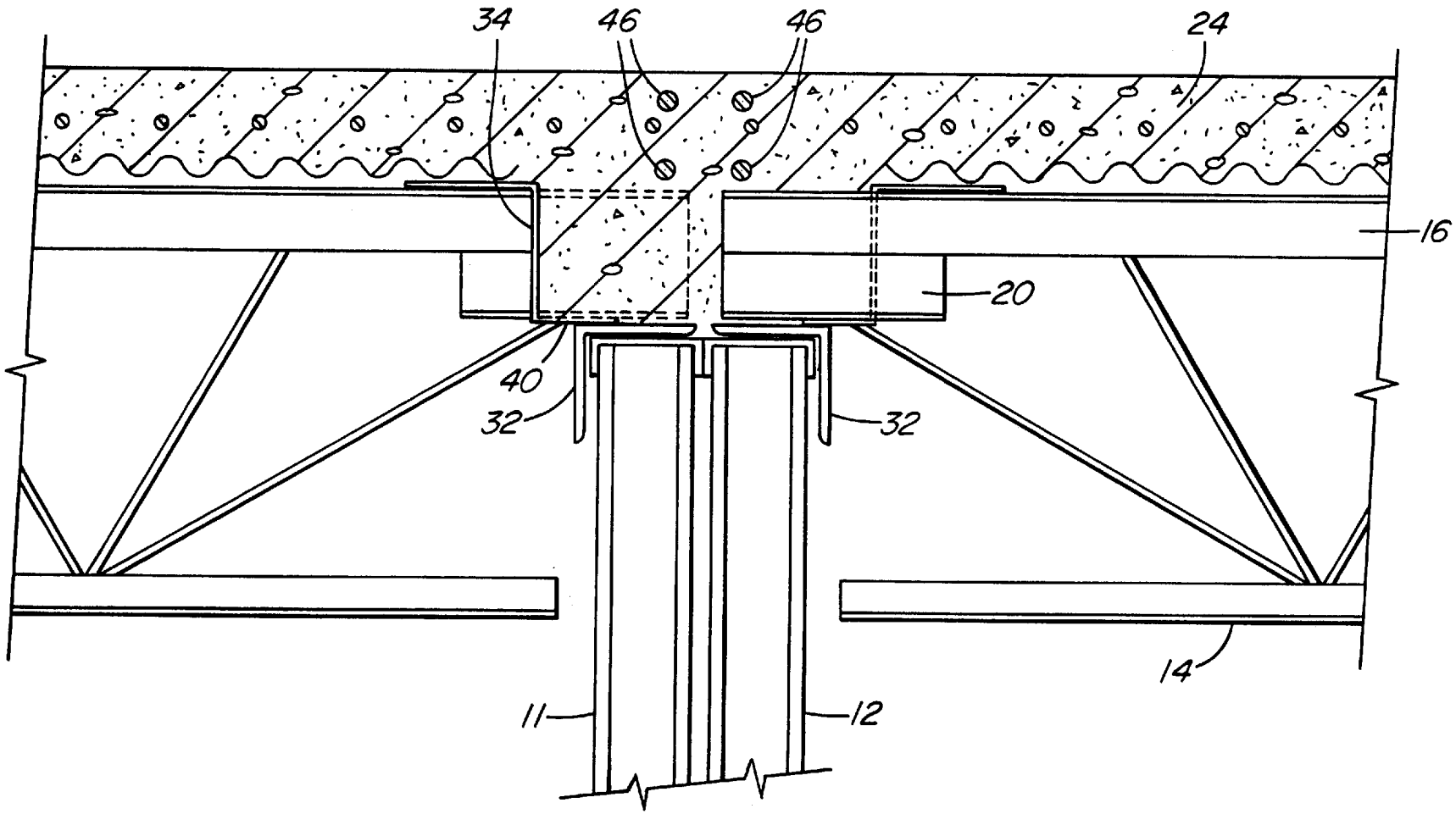
FIG. 13 is a schematic side elevational view in cross-section of a floor constructed in accordance with a further embodiment of the invention.

As seen in FIG. 4, closure 34 may be placed on top of wall 12 so that face 36 is flush with the vertical surface 11 of wall 12. The concrete beam portion 50 of floor 26 formed atop wall 12 in this case is typically non-structural. However, it is possible to construct a structural concrete beam portion 50 using the present system by extending the length of lower flange 40 of closure 34 so that face 36 of closure 34 extends out beyond wall surface 11, as shown in FIG. 13. Trough 42 widens, and with enough reinforcing elements such as reinforcing bars 46, beam portion 50 of floor 26 can act as a structural element. Also, the depth of beam portion 50 can be altered as necessary by altering the depth of joist shoes 20.

In constructing the floor system of the present invention, joists 10 are constructed as required. While most joists 10 will have joist shoes 20 of equal depth, some joist shoes 20 may be deeper and others shallower. Joists 10 are then placed between load beg walls 12, with the joist shoes 20 on each end of joists 10 sitting on the top surface 13 of walls 12. Closures 34, such as those shown in FIG. 6, are fitted onto joist shoes 20 with flanges 40 resting on top surface 13 of wall 12. Metal decking 22 is placed on top of joists 10 and closures 34, care being taken to cut decking 22 so that it does not overlap more than upper flange 38 of closure 34. Concrete 24 is poured on top of metal decking 22 and into the trough 42 formed by opposed overlapping closures 34. It will be appreciated that closures 34 can overlap to any practical length. For this reason, their exact length is not critical. What is important that they overlap at least to some extent. This prevents concrete from leaking out from between adjacent closures.

As will be apparent to those skilled in the art in the light of the foregoing disclosure, many alterations and modifications are possible in the practice of this invention without departing from the spirit or scope thereof. For example, while the upper flanges 38 of closures 34 shown in the accompanying drawings may rest on top of the angle irons which form top chords 16 of joists 10, upper flange 38 may instead abut the underside of said angle irons, with no loss in effectiveness. Accordingly, the scope of the invention is to be construed in accordance with the substance defined by the following claims.

What is claimed is:

1. A concrete floor system comprising:

a. a first generally vertical load-bearing wall having a top;

b. a force-distributing plate capping said top of said wall;

c. a plurality of joists extending from said top of said wall to a second load bearing wall, each of said joists having a top chord, a bottom chord, webbing between said top and bottom chords, and joist shoes having a predetermined end profile at each end of said joists, said joist shoes resting on said force-distributing plate;

d. decking supported on and attached to the top of said joists;

e. means for enclosing a volume formed between said top of said wall, the underside of said decking, and said joists; and f. a concrete slab poured onto said metal decking and into said enclosed volume;

wherein said volume enclosing means comprises a generally z-shaped closure fitted onto each of said joist shoes, each of said closures having a generally vertical face, an aperture in said face intermediate the ends of said closure, said aperture corresponding to said profile of said joist shoes, a lower flange extending from a bottom edge of said closure face toward the centre of said wall, said lower flange resting on top of said force-distributing plate when said closure is fitted onto said joist shoe, and an upper flange extending from a top edge of said closure face which rests on top of said joist shoe, said closure when fitted onto said joist shoe forming a vertical wall between said distribution plate and the top of said joist shoe and between adjacent joists, thereby forming a concrete-accepting trough when fitted onto joists extending in opposite directions away from said wall.

2. The concrete floor system as claimed in claim 1 wherein said joist shoe profile is I-shaped.

3. The concrete floor system as claimed in claim 2 wherein said decking overlaps said top flanges of said closures.

4. The concrete floor system as claimed in claim 3 wherein said poured concrete embeds at least a portion of said joists.

5. The concrete floor system as claimed in claim 4 wherein adjacent of said closures overlap longitudinally when fitted onto adjacent joists.

6. The concrete floor system of claim 5 wherein said face of said closures occupies generally the same vertical plane as one of the faces of said wall.

7. The concrete floor as claimed in claim 5 wherein said face of said closure occupies a vertical plane farther from the centre of said wall than said wall face.

8. The concrete floor as claimed in claim 6 further comprising wire mesh and reinforcing rods embedded into said concrete.

9. The concrete floor as claimed in claim 8 wherein joist shoes of joists extending in opposite directions from said wall are of differing depths.

10. The concrete floor as claimed in claim 9 wherein said joists made of steel and said closures are made of sheet metal.

11. A concrete floor system comprising:

a. a first generally vertical load-bearing wall having a top;

b. a plurality of joists extending from said top of said wall to a second load bearing wall, each of said joists having a top chord, a bottom chord, webbing between said top and bottom chords, and joist shoes having a predetermined end profile at each end of said joists, said joist shoes resting on said load bearing wall;

c. decking supported on and attached to the top of said joists, d. means for enclosing a volume formed between said top of said wall, the underside of said decking, and said joists; and e. a concrete slab poured onto said metal decking and into said enclosed volume;

wherein said wall is an outer wall, and said volume enclosing means comprises an angled member fitted to said distribution plate on one side thereof, and generally z-shaped closure fitted onto each of said joist shoes, each of said closures having a vertical face, an I-shaped void formed in said face intermediate the ends of said closure, said void corresponding to said profile of said joist shoes, a lower flange extending from the bottom of said closure face toward the centre of said wall, said lower flange resting on top of said distribution plate when said closure is fitted onto said joist shoe, and an upper flange extending from the top of said closure face which rests on top of said joist shoe, said closure when fitted onto said joist shoe forming a vertical wall between said distribution plate and the top of said joist shoe and between adjacent joists, thereby forming a concrete-accepting trough.

12. A concrete floor system comprising:

a. a first generally vertical load-bearing wall having a top;

b. a plurality of joists extending from said top of said wall to a second load bearing wall, each of said joists having a top chord, a bottom chord, webbing between said top and bottom chords, and joist shoes having a predetermined end profile at each end of said joists, said joist shoes resting on said load bearing wall;

c. decking supported on and attached to the top of said joists, d. means for enclosing a volume formed between said top of said wall, the underside of said decking, and said joists; and e. a concrete slab poured onto said metal decking and into said enclosed volume;

wherein said volume enclosing means comprises a generally z-shaped closure fitted onto each of said joist shoes, each of said closures having a vertical face, a half-I-shaped void formed in said face at each end of said closure, said void corresponding to a said profile of said joist shoes, a lower flange extending from the bottom of said closure face toward the centre of said wall, said lower flange resting on top of said distribution plate when said closure is fitted onto said joist shoe, and an upper flange extending from the top of said closure face which rests on top of said joist shoe, said closure when fitted onto said joist shoe forming a vertical wall between said distribution plate and the top of said joist shoe and between adjacent joists, thereby forming a concrete-accepting trough when fitted onto joists extending in opposite directions away from said wall.

13. A concrete floor system comprising:

a. a first generally vertical load-bearing wall having a top;

b. a force-distributing plate capping said top of said wall;

c. a plurality of joists extending from said top of said wall to a second load bearing wall, each of said joists having a top chord, a bottom chord, webbing between said top and bottom chords, and joist shoes having a predetermined end profile at each end of said joists, said joist shoes resting on said force-distributing plate;

d. decking supported on and attached to the top of said joists;

e. means for enclosing a volume formed between said top of said wall, the underside of said decking, and said joists; and f. a concrete slab poured onto said metal decking and into said enclosed volume; and g. a void formed in said lower flange, the width of said void corresponding to the width of said joist shoe.

14. A generally z-shaped closure for use in a concrete floor system, said closure having a generally vertical face, an aperture formed in said face intermediate ends of said closure, said aperture having a shape corresponding to a predetermined end profile of joist shoes of a joist, a generally horizontal lower flange extending from a bottom edge of said face, and a generally horizontal upper flange extending from a top edge of said face in an opposite direction from said lower flange.

15. A method for constructing a concrete floor, said method comprising the steps of:

a. providing at least one load bearing wall;

b. providing a plurality of open web joists to be supported by said load bearing wall, said joists having shoes for resting on said load bearing wall;

c. inserting said shoes through an I-shaped aperture in a face of a z-shaped closure, the closure having oppositely extending upper and lower flanges;

d. placing plurality of said joists onto said wall, said fitted closures thereby forming a concrete-accepting trough;

e. applying metal decking to the tops of said joists, overlapping said upper flanges of said closures; and f. pouring said concrete into said trough and onto said decking.

16. The floor constructing method as claimed in claim 11 further comprising the steps of:

a. allowing said concrete to cure, forming a concrete slab floor; and b. drilling holes in said slab floor to accommodate plumbing and electrical services.

17. A method for constructing a concrete floor, said method comprising the steps of:

a. providing at least one load bearing wall capped with a force-distributing plate;

b. placing plurality of open web steel joists having joist shoes onto said force-distributing plate;

c. fitting z-shaped closures having a face, and oppositely extending upper and lower flanges onto joist shoes of said joists, said closures extending between adjacent joists and thereby forming a concrete-accepting trough;

d. applying metal decking to the tops of said joists, overlapping said upper flanges of said closures; and e. pouring said concrete onto said decking and into said trough.

* * * * *

(Also Form PTO-1050)

UNITED STATES PATENT AND TRADEMARK OFFICE

CERTIFICATE OF CORRECTION

PATENT NO : 5,941,035

DATED : 24 August, 1999

INVENTOR(S) : John A.C. Purse

It is certified that error appears in the above-identified patent and that said Letters Patent are hereby corrected as shown below:

In Column 5, line 28 of the specification, the word "fiber" is amended to read --further--.

Signed and Sealed this

Twenty-fifth Day of July, 2000

*Attest:*

*Attesting Officer*

Q. TODD DICKINSON

*Director of Patents and Trademarks*